US005676462A

United States Patent [19]

Fraczek et al.

[11] Patent Number: 5,676,462

[45] Date of Patent: Oct. 14, 1997

[54] SUSPENDED MAGNETIC IMPELLER/ BAFFLE APPARATUS FOR LIQUID

[75] Inventors: Richard M. Fraczek, Brockport; Frank M. Smola; Diana Garcia-Prichard, both of Rochester, all of N.Y.

[73] Assignee: Eastman Kodak Company, Rochester, N.Y.

[21] Appl. No.: 784,160

[22] Filed: Jan. 15, 1997

Related U.S. Application Data

[63] Continuation of Ser. No. 632,872, Apr. 16, 1996, abandoned.

[51] Int. Cl.[6] ..... B01F 13/08

[52] U.S. Cl. ..... 366/171.1; 366/172.2; 366/274; 366/307

[58] Field of Search ..... 366/168.1, 171.1, 366/172.2, 273, 274, 306, 307; 416/3

[56] References Cited

U.S. PATENT DOCUMENTS

| | | | |
|---|---|---|---|
| 1,420,773 | 6/1922 | Stainbrook | 366/274 |
| 1,420,774 | 6/1922 | Stainbrook | 366/274 |
| 3,116,913 | 1/1964 | Lane | 416/3 X |
| 3,245,665 | 4/1966 | Steel . | |
| 3,265,369 | 8/1966 | Harrison | 366/274 |
| 3,494,597 | 2/1970 | Rosinger | 366/273 X |
| 3,570,819 | 3/1971 | Rosinger | 366/274 |
| 3,680,843 | 8/1972 | Lu et al. . | |
| 3,968,773 | 7/1976 | Charland et al. . | |
| 4,162,855 | 7/1979 | Bender | 366/274 |
| 4,940,087 | 7/1990 | Lien et al. . | |

FOREIGN PATENT DOCUMENTS

| | | |
|---|---|---|
| 2007913 | 9/1971 | Germany . |
| 3-89931 | 4/1991 | Japan . |

*Primary Examiner*—Charles E. Cooley
*Attorney, Agent, or Firm*—Arthur H. Rosenstein

[57] ABSTRACT

An apparatus and method for mixing materials such as reactants in a container which reduces or eliminates vortexing and swirling, improves mixing and eliminates degradation of the container and/or impeller comprises a container for holding liquids, a magnetic impeller coupled to a drive magnet located outside the container, where the impeller is suspended from a baffle assembly and located above the bottom of the container, a baffle assembly containing at least two vertical baffle elements with a horizontal cross member connecting the baffle elements, a portion or all of each of the baffle elements spaced from the wall of the container and a tube for providing liquid addition to the vicinity of the highly turbulent mixing around the impeller.

10 Claims, 1 Drawing Sheet

SUSPENDED MAGNETIC IMPELLER/ BAFFLE APPARATUS FOR LIQUID

This is a Continuation of application Ser. No. 08/632,872, filed 16 Apr. 1996 now abandoned.

FIELD OF THE INVENTION

This relates to an apparatus for and a method of mixing. It is related more particularly to a method of mixing liquids such as liquid reactants to form chemical compositions. Useful compositions which are formed from vigorous mixing include photographic compositions such as photographic emulsions.

BACKGROUND OF THE INVENTION

Mixing of liquids is commonly done in a container or vessel using a magnetically driven impeller. Liquids to be mixed are added to the surface or into the container through a tube and the reaction or mixing takes place using vigorous mixing. In laboratory or small scale mixing applications, such as in a container having a capacity of 100 to 5,000 cc, preferably 100 to 2000 cc, mixing is generally done using a coated magnetic impeller such as described in laboratory equipment catalogs, called a bar magnet. The impeller is located on the bottom of the container and rotated by a drive magnet or electronically switched coil located beneath the container.

A major problem with vigorous mixing methods is that vortexes form in the container during mixing. This is caused by an air funnel extending into the liquid. In addition swirling occurs. This is generally evidenced in an overall rotational movement of the liquid during mixing. Typical mixing patterns consist of vortexing and/or swirling, particularly at high impeller speeds such as 300 to 800 rpm depending on the liquid volume.

Vortexing introduces air into the mixture with detrimental effects such as foam and bubbles. Swirling results in inefficient mixing of any liquid being added.

In addition, since the impeller is in contact with the bottom of the container, degradation or wearing of the impeller and/or the container bottom occurs. These degradation products may be detrimental to the mixture.

Thus, in German Patent DE 2,007,913 there is described an impeller which has a bar magnet inside the vessel driven by a magnetically coupled air motor. The drive is mounted in a non-magnetic box which may also serve as a stand. It is used for small scale mixing.

In Japanese patent 3-089,931 mixing includes an inclined cylindrical hollow mixing vessel having a non-magnetic bottom plate made of material having high electric resistance and proper strength, and an openable lid, unit for rotating a mixing vessel from outside a bottom plate while supporting an upper periphery of mixing vessel by guide rollers, and an arcuate progressing magnetic generator arranged along the lower side of the mixing vessel in non-contact manner. A ring-shaped permanent magnet is buried in the bottom plate of the mixing plate, and a material discharge opening and valve are provided in the bottom on one side. A lid of a mixing vessel is provided with a material feed opening, inspection window, a short pipe at the center to be connected to a vacuum pump, and valve and rotary socket in a short pipe. A rotating speed detector is provided outside the mixing vessel in non-contact manner. A rotating unit is also provided with a rotating speed detector.

In. U.S. Pat. No. 3,680,843 there is disclosed a sample mixing system having a multiplicity of sample containers into which are inserted magnetic stirring rods. Each of a pair of pole pieces is connected to an alternating current electromagnet between which pole pieces the sample containers are positioned to intercept the alternating magnetic field generated by the electromagnet causing the magnetic stirring rods to move, thereby stirring the contents of the containers.

In U.S. Pat. No. 3,245,665 a mixing bar for use with magnetic impellers comprising a pair of magnets and an encapsulating body formed of polymeric plastic material enclosing the same, said magnets being permanent magnets oriented in said encapsulating body with their similar poles relatively adjacent each other so that said similar poles oppose each other, means in said encapsulating body for maintaining said magnets in spaced relation, said encapsulating body having a convex bottom, a flat top, and flat sides, said sides extending continuously upwardly to form said bottom to said top, said magnets being of generally elongated shape and having their longitudinal axes below the center of gravity of said encapsulating body is described.

In such containers, baffles have been used to reduce vortexing such as those described in U.S. Pat. No. 4,940,087 and U.S. Pat. No. 3,968,773. Although baffles, per se, do aid in reducing vortexing and swirling, those unwanted effects still present problems in achieving adequate mixing.

SUMMARY OF THE INVENTION

It is an objective of the invention to provide apparatus and method for liquid mixing applications with improved mixing.

It is a further objective of this invention to provide apparatus and method for reducing or eliminating vortexing and swirling in mixing applications.

It is a still further objective of this invention to reduce or eliminate degradation of a container for mixing liquids and/or the impeller used to achieve the mixing of liquids.

It is also an objective of the present invention to provide for sub-surface addition of reactants in a liquid mixing application.

Those and other objectives are accomplished by a container for holding liquids; a magnetic impeller coupled to a drive magnet located outside the container, said impeller suspended from a baffle assembly and located above the bottom of the container; a baffle assembly containing at least two vertical baffle elements with a horizontal cross member connecting the baffle elements, a portion or all of each said baffle elements spaced from the wall of the container; and means for providing liquid addition to the vicinity of the highly turbulent mixing around the impeller.

The present invention also comprises a method of mixing liquids in a container, said method providing a container to hold liquid; providing a magnetic impeller inside the container, which impeller is coupled to a drive magnet located outside the container and wherein the impeller is located around the bottom of the container and suspended from a baffle assembly; the baffle assembly containing at least two vertical baffle elements with a horizontal cross member connecting the baffle elements, a portion or all of each said baffle elements spaced from the wall of the container; and adding a liquid the container in the vicinity of the highly turbulent mixing around the impeller and mixing reactants with the impeller.

The vertical baffle elements, a portion of which are spaced from the wall of the container, eliminate any vortexing or swirling tendency. This feature results in turbulent flow and good mixing as contrasted with laminar flow and poor mixing when vortexing or swirling occur. The suspended impeller eliminates contact between the impeller and container bottom. This feature eliminates degradation or wearing of the impeller and/or the container bottom. The baffle assembly further provides a means for sub-surface addition of liquids wherein a tube is attached to one of the baffle elements with one end of the tube connected to a delivery system and the other end positioned near the impeller. This feature provides for liquid introduction into a highly turbulent mixing regime with good liquid dispersal into the bulk liquid as contrasted with poor dispersal when liquid is added to the surface.

Figure 1:
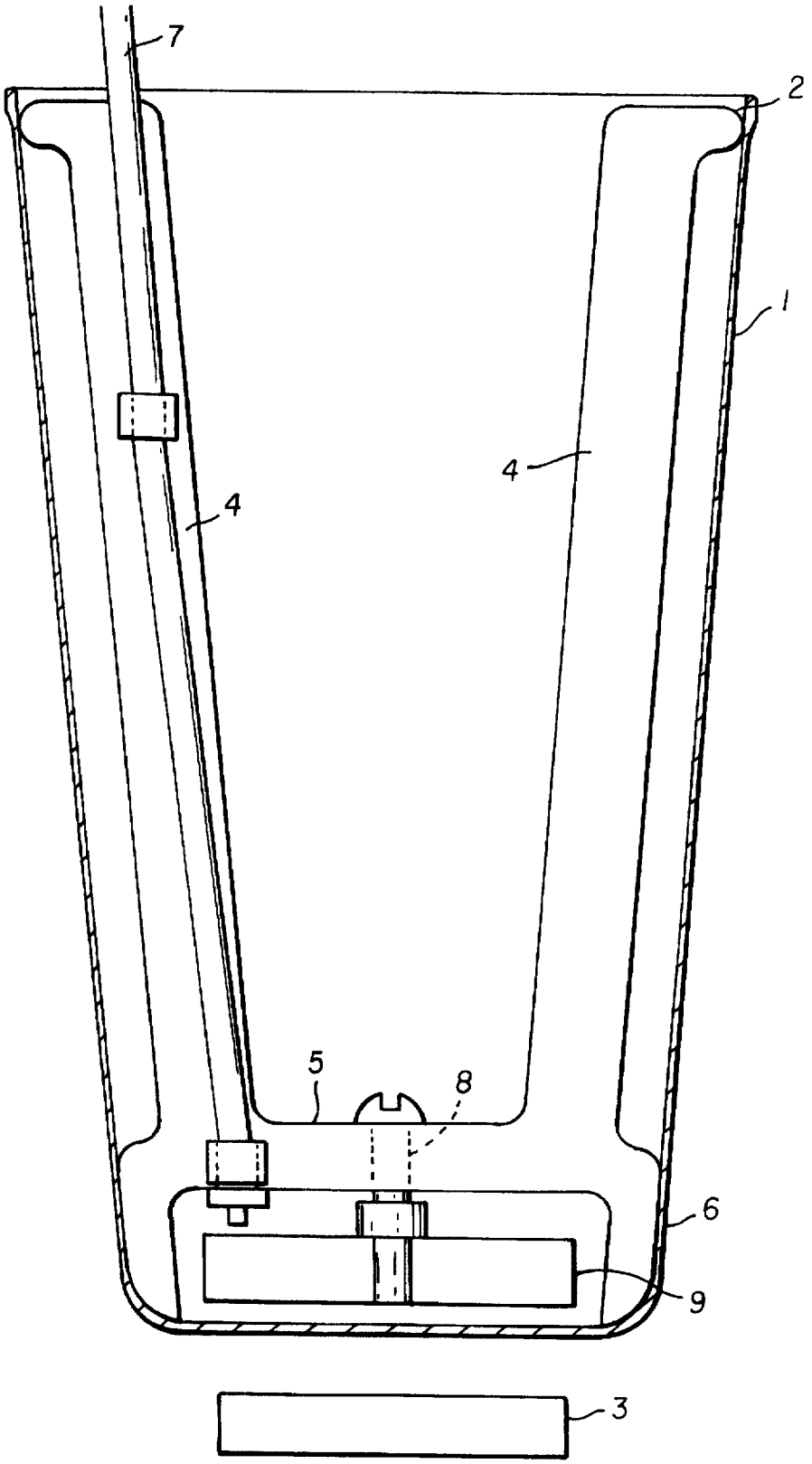
FIG. 1 depicts the invention and shows a container, a baffle assembly, vertical baffles, a suspended impeller, a drive magnet and an addition tube.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

The preferred embodiment of the apparatus, shown in FIG. 1, consists of a container 1, a baffle assembly 2 and a drive magnet 3. The baffle assembly consists of vertical baffle elements 4, a horizontal cross member 5 connecting the baffle elements, legs 6 and addition tube 7 the end of which is located under the surface of liquid in the container. A support shaft 8 passes through the horizontal cross member with one end of the shaft attached to a magnetic impeller 9.

The container (sometimes called a vessel) holds the liquid to be mixed. The container can be formed from any material which does not interfere with the reaction or mixing of the liquids to be mixed. The container can thus, be formed from steel, aluminum, glass, and plastic or the like. Although the apparatus is most useful for laboratory or small scale mixing applications because of ease of use, it can also be used for larger scale applications. It is preferred, in this invention, to use containers having volume capacities of from about 100 to about 2,000 cc.

The liquids to be mixed can be non reactive with each other such as water, salt solutions and the like. However, in the preferred embodiment, the liquid to be added to the subsurface is reactive with respect to one or more of the other liquids to be mixed. Thus, the reactants can be photographic chemicals which are reactant with emulsions, and the like. Whether the liquid is a reactant or not, the mixing must be such that vortexing and swirling are reduced or eliminated.

The magnetic impeller, which is sometimes called a bar magnet, can be formed from neodynium, iron, and boran and can be from 1 to 3 inches in length. It can consist of one or more blades and is suspended above the bottom of the container by a combination of the support shaft and baffle assembly leg lengths.

The suspended impeller eliminates contact between the impeller and container bottom thereby eliminating degradation or wearing of the impeller and/or the container bottom. The impeller moves the liquid in the same rotational direction as the impeller.

The impeller is magnetically coupled to the drive magnet and rotates in the same direction as the drive magnet. It is preferable that the impeller be at least 1/8 inch above the bottom of the container.

The drive magnet can be formed from any material such as neodynium, iron, and boron, and the like and provides the means for rotating the impeller. It can do so by magnetic coupling to the magnetic impeller and is located outside of the container and close to the impeller. It is preferred that the drive magnet be positioned below the container and within about 1 to 2 inches of the impeller.

The baffle assembly comprises two or more baffle elements 4, legs 6 and a horizontal cross member 5. A support shaft 8 passes through the horizontal cross member with one end of the shaft attached to the magnetic impeller 9.

The plurality of baffle elements can be from 2 to 4 in number and can be made from a variety of materials including metals, such as stainless steel; plastic, such as polycarbonate, and the like and it is preferred that they be spaced equally apart from one another. It is preferred to use two baffle elements. The baffle elements impede the rotational motion of the liquid and provide for turbulent movement of the liquid. They result in turbulent flow and good mixing as contrasted with laminar flow and poor mixing when vortexing or swirling occurs. At least a portion of each baffle element must be spaced from the wall of the container. The space between the elements and the wall can be from 1/16 to ¾ inches. The spacing provides for some liquid flow between the baffle and the container wall thereby eliminating dead zones or regions of reduced liquid movement which occur behind the baffle elements in the absence of the spacing.

The leg lengths are used to keep the impeller away from the container bottom.

The horizontal cross member can be formed from plastic, and the like and connects the baffle elements and provides a means for positioning the support shaft.

The shaft 8 is used to support the impeller.

The means for providing liquid addition to the vicinity of the highly turbulent mixing around the impeller can be any means for having the liquid to an introduction point in the vicinity of the impeller. It is preferably a tube, one end of which is connected to a liquid delivery system (not shown) and the other end is in the vicinity of the highly turbulent mixing around the impeller thereby providing a means for liquid addition into a highly turbulent mixing regime with good liquid dispersal into the bulk liquid as contrasted with poor dispersal when liquid is added to the surface.

The other end of the tube is preferably within ⅛ inch of the impeller.

The tube may be connected to the baffle assembly by brackets and can be formed from any material which would not adversely affect the liquid added to the subsurface, such as plastic and the like.

EXAMPLE

Various mixing apparatus were tested to determine the quality of mixing of materials in containers having a capacity of 1000 cc and wherein the mixing material, water, had a volume of 350 cc to 500 cc in the container. Two impellers, a four bladed impeller (SpinPlus™) and a flat bladed turbine impeller (FBT) having various diameter sizes were used.

The mixing results are reported in Table 1.

TABLE 1

| | A | B | C | D | E | F | G | H | I | J | K |
|---|---|---|---|---|---|---|---|---|---|---|---|
| Fluid | Water | Water | Water | Water | Water | Water | Water | Water | Water | Water | Water |
| Vol. | 350 cc | 350 cc | 350 cc | 350 cc | 350 cc | 350 cc | 350 cc | 350 cc | 350/500 cc | 350/500 cc | 350 cc |
| Impeller | SpinPlus | SpinPlus | FBT | FBT | FBT | FBT | FBT | FBT | FBT | FBT | FBT |
| Diameter | 1 ½" | 1 ½" | 1 ¾" | 1 ¾" | 1 ¾" | 1 ½" | 1 ¾" | 2" | 1 ¾" | 1 ¾" | 1 ¾" |
| Magnet diameter | — | — | 3/16" | 3/16" | 3/16" | 3/16" | 3/16" | ¼" | 3/16" | 3/16" | 3/16" |
| Blade Height | ½ | ½ | ½ | ⅜" | ⅜" | ⅜" | ⅜" | ½ | ½ | ½ | ½ |
| Blade thickness | ¼" | ¼" | ⅛× ¼" | ⅛× ¼" | ⅛× ¼" | ⅛× ¼" | ⅛× ¼" | ⅛× ¼" | ¼" | ¼" | ⅛× ¼" |
| Baffle Type | none | suspended baffle with the impeller on bottom | suspended impeller baffle elements moved away from wall | suspended impeller baffle elements moved away from wall | suspended impeller baffle elements away from wall | suspended impeller baffle elements 0" from wall | suspended impeller baffle elements 0" from wall | suspended impeller baffle elements 0" from from | suspended impeller baffle elements 1/16" from wall | suspended impeller baffle elements ⅛" from wall | suspended impeller baffle elements ⅛" from wall |
| RPM | | | | | | Mixing | | | | | |
| 221 | OK | OK | OK* | OK* | OK* | OK* | OK* | OK* | OK* | OK* | OK |
| 281 | OK | OK | OK* | OK* | OK* | OK* | OK* | OK* | OK* | OK* | OK |
| 336 | NG | Accept | OK* | OK* | OK* | OK* | OK* | OK* | OK* | OK* | OK |
| 384 | NG | Accept | OK* | OK* | OK* | OK* | OK* | OK* | OK* | OK* | OK* |
| 429 | NG | Accept | OK | OK | OK | OK* | OK* | OK* | OK* | OK | OK* |
| 477 | NG | Accept | OK | OK | OK | OK* | OK* | OK* | OK | Accept | OK* |
| 520 | NG | Accept | OK | OK | OK | OK* | DS | OK* | Decouple | Decouple | OK* |
| 557 | NG | Accept | OK | OK | Accept | OK* | Decouple | DS | | | OK* |
| 595 | NG | Accept | Accept | Accept | Decouple | OK* | | Decouple | | | OK* |
| 623 | NG | Accept | Decouple | Decouple | | OK* | | | | | OK* |
| 660 | NG | Accept | | | | OK* | | | | | OK* |
| 689 | NG | NG | | | | DS | | | | | OK |
| 719 | NG | NG | | | | Decouple | | | | | OK |
| 750 | NG | NG | | | | | | | | | Increased drive magnet strength |
| 803 | NG | NG | | | | | | | | | |

OK = good mixing, no vortex
OK* = not tested, good mixing assumed based on test at higher impeller speeds
Accept = acceptable mixing, slight surface swirls
NG = unacceptable mixing, deep vortex or vortex extending to impeller
DS = dead spot
Decouple = impeller not spinning As seen from the above table, excellent results were obtained using a suspended impeller with the baffle elements moved away from the wall of the container. In Example A, a container wherein no baffle was used gave unacceptable results. In Example B, a container wherein the baffle was suspended with the impeller on the bottom of the container also resulted in acceptable mixing but also resulted in degradation of the container by the spinning impeller on the container bottom. In Examples F, G and H, a container wherein the baffle elements were not spaced from the wall, otherwise resulted in acceptable mixing, but dead spots were observed. Dead spots are areas of reduced mixing. In comparison, in Examples C, D, E, I, J and K of the invention, excellent mixing was observed. In Example K, increased drive magnet strength resulted in good mixing at highly accelerated speeds.

In addition it was found that the Reynolds number, a measurement of mixing, was dramatically increased using a suspended flat bladed turbine impeller as opposed to prior art non-suspended magnetically coupled impellers.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. An apparatus for mixing liquids comprising:

a container for holding liquids;

a baffle assembly containing at least two vertical baffle elements with a horizontal cross member connecting the baffle elements, a portion or all of which said baffle elements being spaced from an inside wall of the container;

a magnetic impeller coupled to a drive magnet located outside the container, said magnetic impeller suspended from said horizontal cross member to control the mixing of the liquids in the container, said baffle elements extending from the bottom of the wall of the inside of the container to above the impeller; said impeller creating a vicinity of highly turbulent mixing around the impeller; and means for providing liquid addition to the vicinity of the highly turbulent mixing around the impeller having an outlet above the impeller.

2. The apparatus of claim 1 wherein the container is a vat.

3. The apparatus of claim 1 wherein said drive magnet is located under the container.

4. The apparatus of claim 1 wherein the baffle assembly contains two baffle elements.

5. The apparatus of claim 1 wherein the means for providing liquid addition comprising a tube attached to the baffle assembly, one end which extends above the container and to which liquid is supplied and the other end comprises said outlet.

6. The apparatus of claim 5 wherein the other end of the tube is within ⅛ inch of the impeller.

7. The apparatus of claim 1 wherein the baffle elements are located from about 1/16 to about ¾ inches from the inside wall of the container.

8. The apparatus of claim 1 wherein the impeller contains a plurality of blades.

9. The apparatus of claim 1 wherein the container has a capacity of 100 cc to 5,000 cc.

10. A method of mixing liquids in a container comprising:

providing a container to hold liquids;

providing a magnetic impeller inside the container, which impeller is coupled to a drive magnet located outside the container and wherein the impeller is located above a bottom of the inside of the container;

said impeller creating a vicinity of highly turbulent mixing around the impeller;

providing a baffle assembly containing at least two vertical baffle elements to control the mixing of the liquids in the container, said baffle elements extending from the bottom of the inside of the container to above the impeller with a horizontal cross member connecting the baffle elements, a portion or all of which said baffle elements being spaced from a wall of the container; said impeller suspended from said horizontal cross member; and adding a liquid above the impeller in the vicinity of the highly turbulent mixing around the impeller and mixing the liquids with the impeller.

* * * * *